US005749576A

United States Patent [19]

Heinen et al.

[11] Patent Number: 5,749,576

[45] Date of Patent: May 12, 1998

[54] GAMING MACHINE

[75] Inventors: Horst Heinen, Stromberg; Konrad Rieck, Gau-Algesheim; Martin Kawka, Waldalgesheim; Jürgen Schattauer, Hüttelsheim, all of Germany

[73] Assignee: NSM Aktiengesellschaft, Germany

[21] Appl. No.: 507,457

[22] PCT Filed: Sep. 26, 1994

[86] PCT No.: PCT/EP94/03204

§ 371 Date: Aug. 28, 1995

§ 102(e) Date: Aug. 28, 1995

[87] PCT Pub. No.: WO95/18428

PCT Pub. Date: Jul. 6, 1995

[30] Foreign Application Priority Data

Dec. 30, 1993 [DE] Germany ..... 43 45 021.0

[51] Int. Cl.[6] ..... A63F 9/00

[52] U.S. Cl. ..... 273/138.1

[58] Field of Search ..... 273/138 R, 139, 273/142 R, 142 B, 138.1; 434/404, 405

[56] References Cited

U.S. PATENT DOCUMENTS 5,154,420 10/1992 Gutknecht ..... 273/138 A

FOREIGN PATENT DOCUMENTS 2114347 8/1983 United Kingdom .

2165074 4/1986 United Kingdom .

2169737 7/1986 United Kingdom .

2222712 3/1990 United Kingdom .

*Primary Examiner*—William H. Grieb

*Attorney, Agent, or Firm*—Ostrolenk, Faber, Gerb & Soffen, LLP

[57] ABSTRACT

A gaming machine preferably operated by coins possesses features located on moving carrier means preferably provided with their own drives, the relative position of which features to each other decides at the standstill of the carrier means at the end of a game on win or loss. To allow a player to cash in winning after each step of the game or, however, to risk the stakes or winnings in following steps of the game, each carrier means is moved individually one after the other for a certain time determined by chance or by hand. After each movement a win is obtained if the features are located in a predetermined position at the standstill of the carrier means.

1 Claim, 6 Drawing Sheets

GAMING MACHINE

Figure 1:
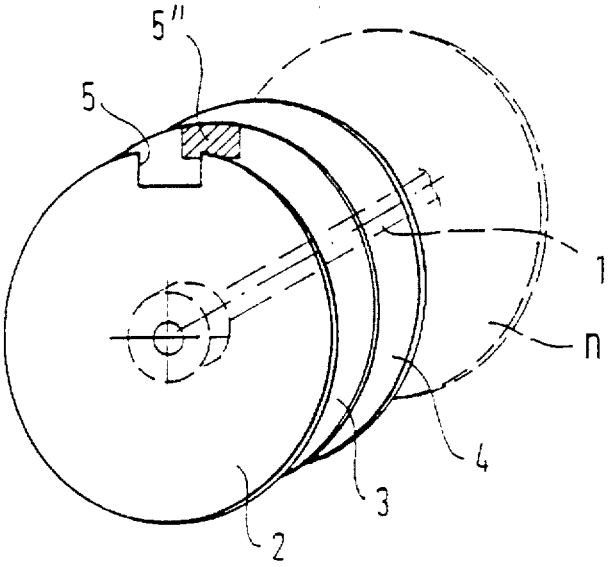

The invention relates to a gaming machine preferably operated by coins with features situated on moving carrier means preferably provided with their own drives the relative position of which features to each other at the end of a game with the carrier means standing still decides on win or loss.

Gaming machines of this type with symbols situated on rotary bodies, for example disks, which symbols are brought out of their revolution to a standstill in a random fashion and which in their standstill states show symbol combinations which decide on win or loss, are known in different versions.

The object of the invention is to create a gaming machine which allows a win to be cashed after each step of the game or, on the other hand, to risk a stake or winnings in following game steps.

This object is solved in accordance with the invention with a gaming machine of the type given above in that each carrier means is moved individually one after the other for a time determined by chance or by hand and that after each movement a win is obtained if the features are located in a predetermined position with the carrier means at standstill.

The gaming machine in accordance with the invention puts into practice a simple game idea which consists of the player putting up a stake and the gaming machine only deciding on win or loss in each step of the game. Here, the player can decide after each step of the game whether he is satisfied with any winnings gained or whether he wants to risk these as the stake in the following step of the game. The machine can naturally also be designed in such a way that the player cannot decide after every step whether he wants to continue the game or not, but that the machine necessarily performs several or a predetermined or selectable number of steps of the game.

Moreover, the machine can be provided with different probabilities for a win or a loss in each step of the game. For example, a 50% or even a lower chance of winning can be given.

The game can be designed in such a way that in each step of the game the total winnings won in the previous step of the game are again put up as stakes so that the winnings from the original stake is doubled with each step of the game until final winnings are paid out or everything is lost.

In accordance with an advantageous embodiment of the invention it is provided that the carrier means comprise disks with bearings on the same axes and provided with their own drives which disks are provided with identical boreholes or openings located at a distance to each other on circles with equal diameters or in the case of disks with equal diameters with identical edge grooves located at a distance to one another. If each disk is provided with only one borehole or one edge groove, winnings are obtained if the borehole or the groove of the first disk when brought to a standstill after one revolution is flush with the borehole or edge groove of the second disk. If the boreholes or edge grooves are flush, sight of the third disk is given which then signals a win.

The individual disks can be provided with two or more positions of rest in which these can be brought to a standstill in a random fashion. If only two positions of rest exist, the one will correspond to a win and the other to a loss so that in each step of the game, which consists of the starting and stopping of a disk, a chance of winning of 50% exists.

In accordance with one game variation, a ball or a pin is provided which meshes with flushing boreholes or openings at standstills of the disks. If, therefore, the ball falls through flushing boreholes of disks following after one another after the standstill of a disk, this signals a win. Accordingly, with flush boreholes a pin can penetrate the stack of disks more deeply from one step of the game to the next and so show a win.

In accordance with another advantageous embodiment, it is provided that the carrier means comprises rings supported concentrically which are provided on their annular mantle surfaces with boreholes or openings positioned at distances. If the boreholes of rings following on to each other are flush after the standstill of each ring, a win is obtained. To show the win, a ball or a pin can again be provided which penetrates the boreholes from ring to ring and thus shows a win, but which strikes a mantle surface for a loss.

The carrier means can comprise slides piled on top of each other with holes or openings located on these.

In accordance with another embodiment it is provided that the carrier means comprise slides provided with compartments in the form of drawers of which the bottoms of individual compartments possess openings. If a ball is used as the means of showing a win or a loss, said ball will fall through the opening in the event of a win into a compartment positioned below which possesses an opening or no opening.

In accordance with a further preferred embodiment of the invention it is provided that the carrier means comprises rings concentric to a central circular disk and that each ring shows in its win position parts of a picture matching the circular disk and/or the neighbouring ring. The rings can again possess one or also several positions of rest depending on the win probability with which the game is to be played.

The idea of the game can be put into practice by means of a further gaming machine in that a disk is provided with windows positioned in a row or on a circle and that behind the windows a belt which can be driven and provided with at least one symbol or a rotating disk which can be driven and where a win is obtained if the symbol appears in a predetermined window. The disk or the belt is driven intermittently with predetermined positions of rest. The symbols are positioned on the disk or on the belt in a sequence corresponding to the desired probability.

In a further gaming machine the idea of the game is put into practice in accordance with the solution of the object in that several boxes are provided which can be divided by insertable walls into compartments into which boxes a ball or similar can be shot and in that the compartments can alternatively be opened or their contents made visible. Depending on whether the ball is located in a certain compartment, a win is obtained or a loss recorded.

In accordance with a further gaming machine it is provided in accordance with the invention that several rows of compartments on top of each other are provided whose number reduces from row to row from bottom to top by one compartment, that only one compartment is situated in the topmost row, that the compartments of each row are positioned in a staggered fashion to those of the row below in such a way that the upper compartment is positioned centrally on the dividing wall of two compartments below, that the bottom of at least one compartment in each row is provided with a hole which opens into a compartment of the two compartments below and that means are provided to determine in which of the compartments below a ball is located which is thrown into the topmost compartment. In this gaming machine, the ball can fall in each step of the game from the one compartment of a row into a compartment of the next row with a win being obtained if the ball reaches a compartment of the next row in each case.

The gaming machine in accordance with the invention can also be put into practice in accordance with another version in that a row of switches or similar is provided which can be switched at random one after the other and in which an input signal to the next switch can only be switched in one switch position. With this gaming machine a win is obtained only if the input signal is switched through to the next switch in one step of the game.

The gaming machines in accordance with the invention cannot only be used to obtain monetary winnings, they can also be installed in existing gaming machines in order to obtain increased chances of winning within the framework of the game of these machines, for example, a doubling of chances.

Figure 2:
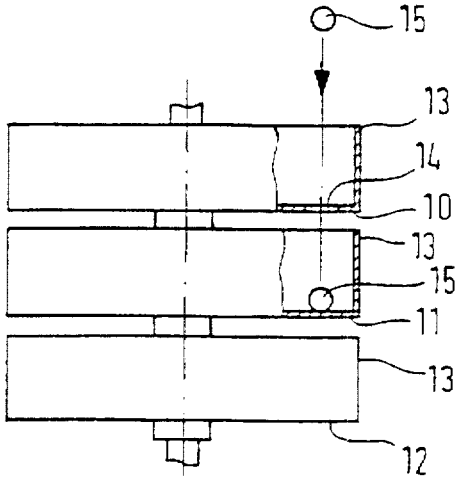
Figure 2A:
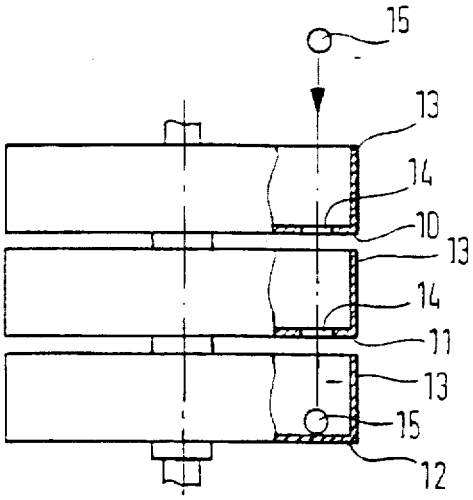
Figure 2B:
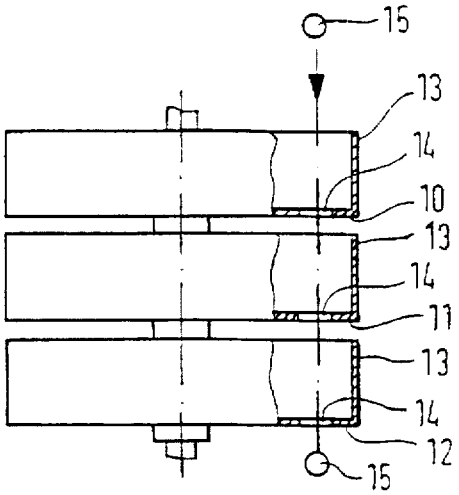
Figure 3:
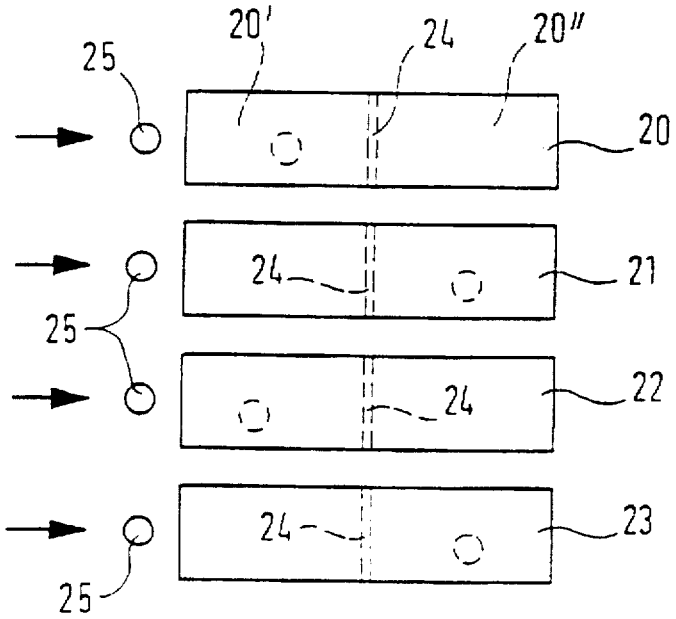
Figure 4:
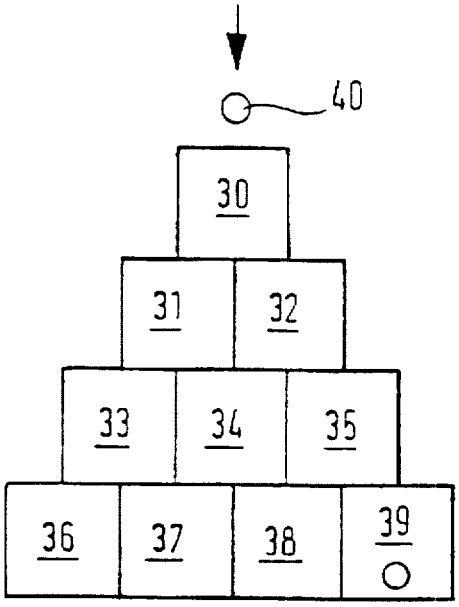
Figure 5:
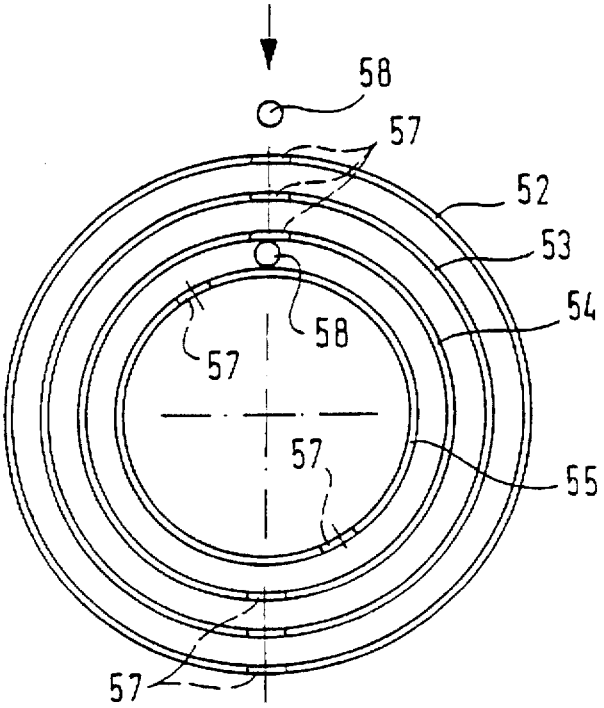
Figure 5A:
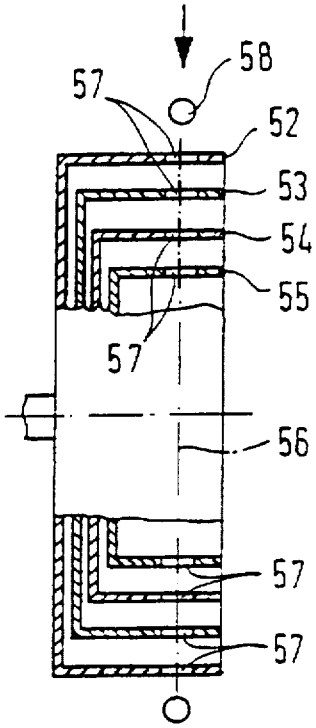
Figure 6:
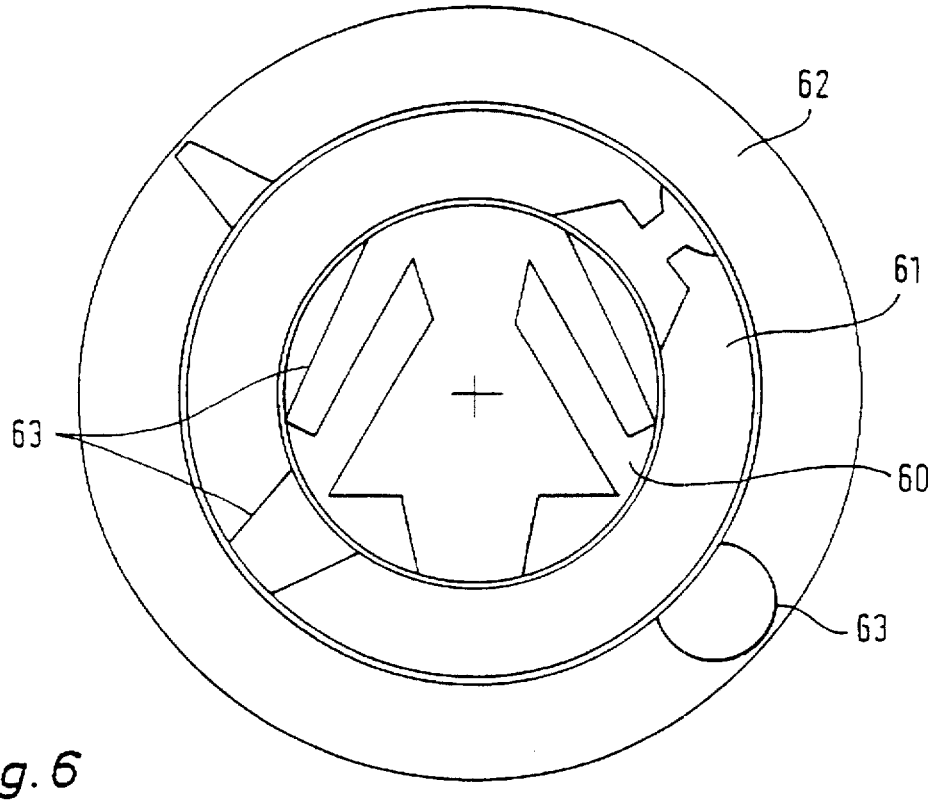
Figure 6A:
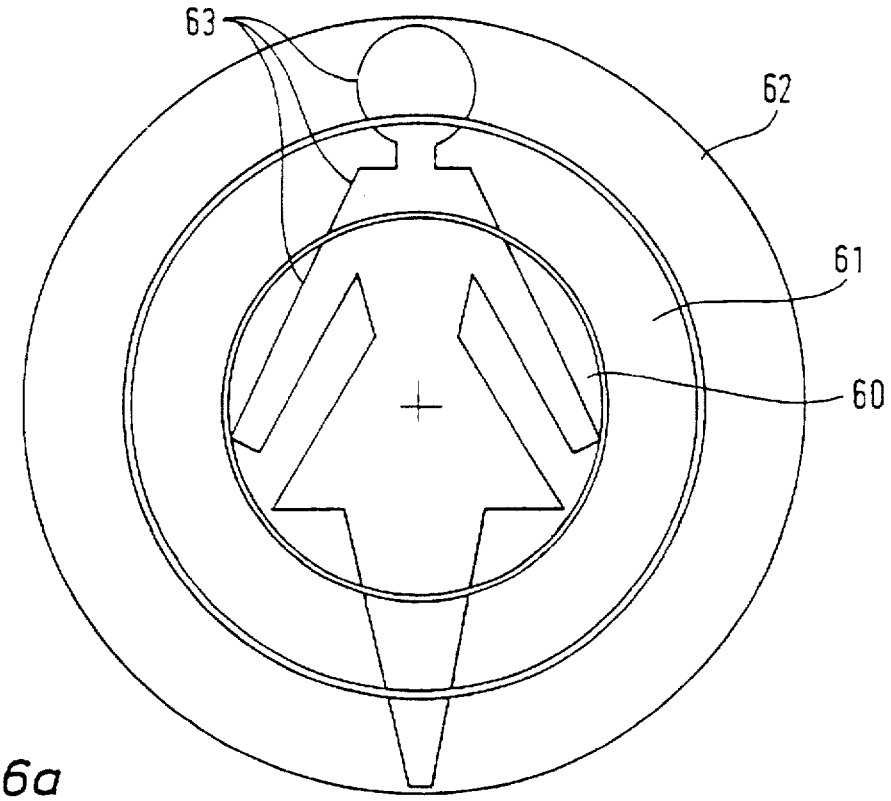
Figure 7:
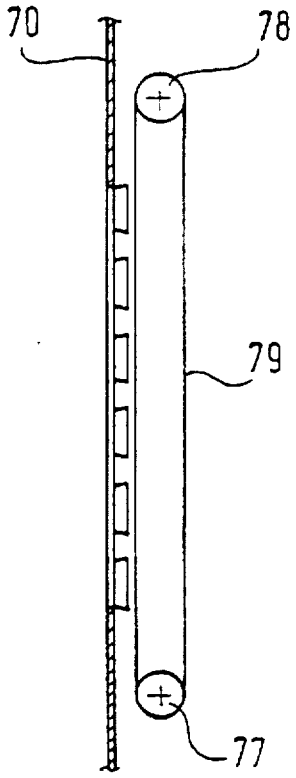
Figure 7A:
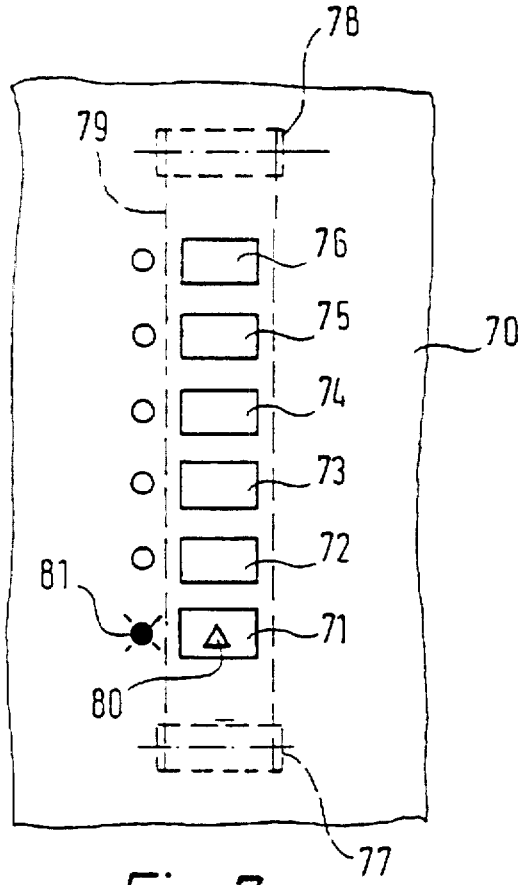

Embodiments of the invention are described in more detail below by means of the drawing. In this drawing FIG. 1, FIG. 1*a* and FIG. 1*b* show a gaming machine with disks situated on the same axis, FIG. 2, FIG. 2*a* and FIG. 2*b* show a gaming machine with playing disks situated on the same axis and provided with drum-like edges, FIG. 3 shows a gaming machine with boxes or chambers positioned on top of each other which boxes or chambers can be sub-divided by intermediate walls, FIG. 4 shows a gaming machine with chambers positioned in rows, FIG. 5 and FIG. 5*a* shows a gaming machine with concentric rings, FIG. 6 and FIG. 6*a* shows a gaming machine with concentric rings which show a complete picture in one position, and FIG. 7 and FIG. 7*a* shows a gaming machine comprising a row of windows behind which a continuous belt runs provided with at least one symbol.

Figure 1A:
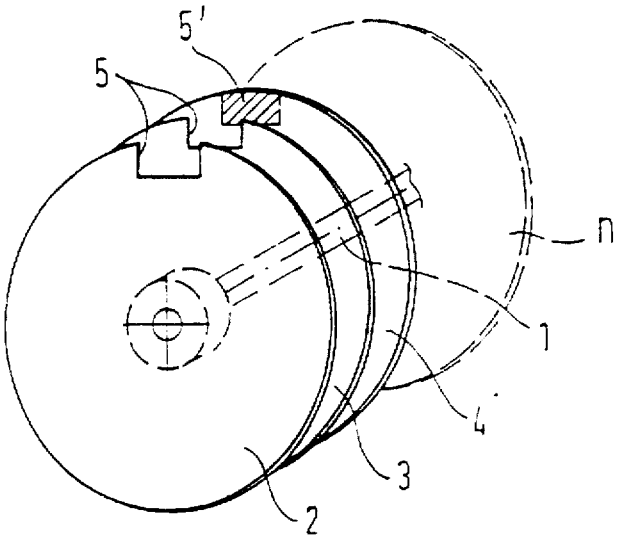
Figure 1B:
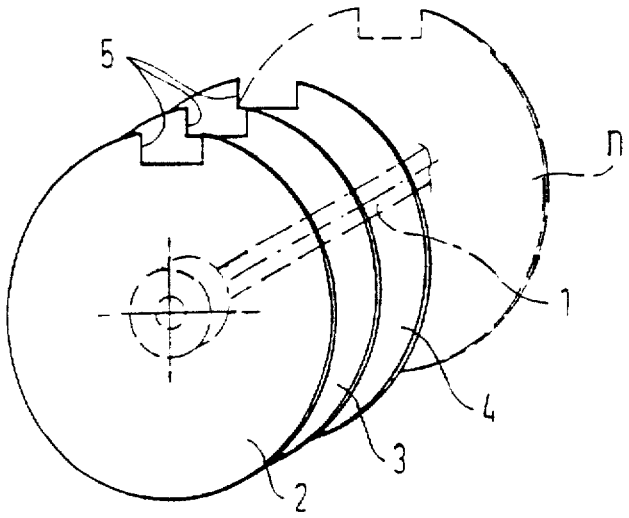

In the gaming machine shown schematically in FIGS. 1 to 1*b*, disks 2, 3, 4 to n are positioned in a rotating manner on the same axis on axle 1 and provided with their own drives. The disks possess the same diameter and on their circumferences each possess a groove 5 which has the same shape on all disks. In each step of the game, the disks 2 to n are set into rotation one after the other and brought to a standstill at random. If in the first step of the game disk 2 is set into rotation and brought to a standstill at random, a win is obtained if the notch 5 of the first disk 2 is flush with the notch 5 of the second disk 3 so that sight of the third disk 4 is given as is shown in FIG. 1*a* by the hatching 5'.

If after the standstill of the first disk 2, however, only sight of the hatched area 5" of the second disk is given in accordance with FIG. 1, that is without the flush position of two grooves 5, this means a loss.

With a 50% chance of winning, the disks 2 to n possess only two positions of rest in which the grooves are either flush to each other or not. If with only one groove 5 several positions of rest are possible, a correspondingly lower probability is generated.

In the embodiment in accordance with FIGS. 2 to 2*b* disks 10, 11, 12 to n (not shown) again supported on the same axes and provided with their own drives are provided. Individual disks of the same diameter are provided with circumferential cylindrical edges 13. On respective concentric circles the disks are provided with respective boreholes 14 where wins can be obtained if two following boreholes 14 are flush so that a ball 15 can fall through them.

In the gaming machine shown schematically in FIG. 3, chambers 20, 21, 22, 23 to n are positioned on top of each other which chambers can be sub-divided in each case by insertable intermediate walls 24 or other subdivisions. Here, balls 25 are shot from the side into the chambers 20 to n. Win or loss is decided upon in each case by one of the partial chambers 20', 20" in which the ball comes to rest or in which this is located after the insertion of the intermediate wall 24.

In the embodiment in accordance with FIG. 4 chambers 30 to 39 are positioned in rows following on to each other where the number of chambers decreases from the bottom-most row to the top and where only one chamber 30 is located in the topmost row. The chambers of each row are positioned in a staggered fashion to the chambers of the lower rows in such a way that one chamber always partially covers two chambers of the row below. The ball 40 can fall from the top chamber 30 into one of the two lower chambers 31, 32. To win in the first step of the game, a correct guess must be made as to which of the two chambers 31, 32 the ball is located in.

In a following step of the game, the ball can, depending on whether it is located in chamber 31 or 32, fall into one of the chambers 33, 34 or 34, 35. In this following step of the game, a win is again obtained if the chamber is guessed correctly. That is, in each step of the game win or loss is determined by correctly determining or opening the chamber in which the ball 40 is located.

With the gaming machine in accordance with FIGS. 5, 5*a*, disks of the same axes with concentric, annular edges 52, 53, 54, 55 are provided which are provided in their mantles in a common diameter plane 56 with boreholes 57. In each step of the game a disk following the first disk is set into rotation. In each step of the game a win is obtained, if boreholes 57 of disks following on to one another come to a standstill in a flush position so that a ball 58 can fall through the boreholes. If the ball 58 hits, as shown in FIG. 5, the mantle of the inner ring 55 without falling through the hole 57, a loss has occurred in the corresponding step of the game.

The game can also be continued with corresponding steps of the game through the lower bowls of the annular edges 52 to 55 until the ball 57 has gone through all flush boreholes.

In the embodiment shown the cylindrical edges 52 to 55 are each provided on opposite sides with two boreholes 57 where the number of positions of rest can be selected.

With the embodiment in accordance with FIGS. 6 and 6*a* a central disk 60 is provided which is enclosed concentrically by rotating disks 61, 62. A picture or a figure 63 is applied to the disk 60 and the rings 61 and 62 which picture or figure only shows a correctly assembled picture in one position of rest of the rings. The rings 61, 62 are set into rotation one after the other and brought to a standstill at random with a win being obtained in each position of a ring if its picture part correctly matches the picture part of the central disk or that of the previous ring.

The win positions can be seen from FIG. 6*a* while FIG. 6 shows the rings in their position showing a loss.

In the FIGS. 7 and 7*a* a gaming machine is shown schematically in which a disk 70 is provided with window sections 71 to 76 in a ladder-like form. Behind the window array, a continuous belt 79 runs over rollers 77, 78 which belt is provided with a symbol 80. In each step of the game, the belt 79 is started and brought to a standstill at random. If the symbol 80 appears in a predetermined window 71 to 76, a win has been obtained. The window valid in each case can be marked by the switching on of a lamp 81. Correspondingly to the given chances of winning, the belt 79 possesses a predetermined number of positions of rest.

We claim:

1. Gaming machine, comprising a movable disk provided with windows positioned in predetermined positions; carrier means located behind the windows and provided with at least one symbol; and means for moving the carrier means and for randomly stopping the carrier means, a win being obtained if at the randomly determined standstill of the carrier means the symbol appears in a predetermined window, wherein the windows are positioned in predetermined positions in a row and the carrier means comprises a belt.

* * * * *